United States Patent [19]

Wright et al.

[11] 4,131,033

[45] Dec. 26, 1978

[54] PUSH-PULL AND ROTATING KNOB

[75] Inventors: Norman Z. Wright, Marion; Davey L. Printy, Cedar Rapids, both of Iowa

[73] Assignee: Rockwell International Corporation, El Segundo, Calif.

[21] Appl. No.: 769,979

[22] Filed: Feb. 18, 1977

[51] Int. Cl.[2] ..... G05G 1/10

[52] U.S. Cl. ..... 74/553; 74/504; 200/336; 200/316

[58] Field of Search ..... 74/553, 511 R, 503, 74/504, 10.22, 10 R; 200/336, 308, 316, 314, 340, 296; 116/124.2 A, 124.2 R, 133, 129 P, DIG. 28

[56] References Cited

U.S. PATENT DOCUMENTS

| | | | |
|---|---|---|---|
| 2,516,771 | 7/1950 | Herscher | 74/553 |
| 2,693,165 | 11/1954 | Appleman | 200/316 |
| 2,899,841 | 8/1959 | Meloy | 74/553 |
| 3,121,346 | 2/1964 | Sutton | 74/503 |
| 3,241,515 | 3/1966 | Franklin | 74/10 |
| 3,721,789 | 3/1973 | Black | 200/308 |

*Primary Examiner*—Samuel Scott
*Assistant Examiner*—Gerald Anderson
*Attorney, Agent, or Firm*—Richard A. Bachand; Richard K. Robinson; H. Frederick Hamann

[57] ABSTRACT

A knob adapted for mounting on a control shaft of a control device permits push-pull and rotary functions of the device to be selected. A rotatable skirt section through which the shaft extends covers unselected indicia on a display panel. A window on a portion of the skirt permits only a selected indicia to be seen. Upwardly extending arm members are attached to the skirt section, and are slidably received within channels of an overlying knob section. The overlying knob section is slidable upwardly and downwardly upon the upstanding arm members, but engages the arm members when the knob is rotated to facilitate rotational selection of the control functions. A spring biasing means is provided to maintain the skirt portion in a position adjacent the display panel to reduce the escape angle from under the skirt of light which may be provided within the display panel to illuminate the indicia, and to reduce paralax in viewing the selected indicia.

8 Claims, 5 Drawing Figures

PUSH-PULL AND ROTATING KNOB

BACKGROUND OF THE INVENTION

1. Field of the Invention

This invention relates to knobs for use with multi-functional control devices, and, more particularly, to an improved knob for use with control devices having push-pull and rotary selectable functions.

2. Description of the Prior Art

In many environments in which space is at a premium, such as in an aircraft cockpit or the like, often control functions are consolidated to be controllable by a single device having a single control knob. For instance, oftentimes a switch or rheostat which has a rotational function may be combined with a push-pull function as well, which may operate separately or in conjunction with the rotary function.

In a typical aircraft cockpit environment, for example, such multi-functional control device may be mounted behind an instrument or display panel with a control shaft extending through it for operation of the control device. Typical display panels have various indicia formed thereon which indicate various positions of the control device or the functions selectable by the control device. Often, back lighting means are provided, such as by a lighted plexiglass sheet or the like over which is placed an opaque panel having apertures or transparent areas forming the desired indicia, so that light passes through the various indicia forming apertures or portions to indicate the various functions at corresponding rotational positions of the control device.

Ordinarily, control knobs include a skirt to cover the unselected indicia having a windowed portion to enable only a particular selected indicia to be seen. The knobs in use typically are of a unitary structure so that to operate the push-pull function of the control device the entire knob is merely pushed into or pulled from the direction of the display panel. The rotational function is selected merely by rotating the knob.

When such knob is pulled from the panel, however, the skirt is raised a distance above the panel from its usual position. This often undesirably permits light from the unselected indicia to be seen from under the skirt over relatively large angles from the display panel. Additionally, in the pulled position, since the relative positions of the indicia and the window of the skirt are changed, the paralax encountered in identifying the particular selected indicia becomes significant. Both of these problems may be undesirable, especially in an aircraft cockpit environment where at night the amount of stray or annoying light must be minimized, and at all times the positive identification of selected functional indicia must be promoted.

SUMMARY OF THE INVENTION

In light of the above, it is therefore an object of the invention to provide a knob which is of simple construction for use with multi-functional control devices requiring both push-pull and turning or rotating selections.

It is another object of the invention to provide such knob for use with multi-functional control devices when used with an associated lighted display panel which reduces the amount of visible light escaping from underlying unselected indicia.

It is another object of the invention to provide an improved knob for use with multi-functional control devices which reduces the amount of paralax in viewing a selected indicia upon an associated underlying display panel during especially the use of a "pull" function.

It is still another object of the invention to provide a knob for use with push-pull and rotational control devices which provides a facility to easily vary the spring tension resisting the "push" selection.

These and other objects, features, and advantages will become apparent to those skilled in the art from the following detailed description when read in conjunction with the accompanying drawings and appended claims.

The invention, in its broad aspects, presents a knob adapted to be mounted upon a shaft of a multi-purpose control device having push-pull and rotary selectable functions carried upon a display panel having position or function indicating indicia thereon. The knob includes a skirt adapted to be positioned on the shaft adjacent the display panel to cover the indicia. The skirt includes a transparent or windowed portion for disclosing selected indicia, and has upwardly extending attached arms. An overriding knob adapted to be attached to the shaft has channels for axially slidably receiving the upwardly extending arms of the skirt to facilitate the push-pull functions of the control device, the walls of the channels engaging the arms to facilitate the rotary functions.

In one embodiment, the knob includes a spring biasing means urging the knob away from the skirt to a "pull" position of the control, while maintaining the skirt at a position adjacent the panel. This position at which the skirt is always maintained restricts the view of the covered unselected indicia, and minimizes the paralax in viewing the selected indicia within the transparent portion or window of the skirt.

BRIEF DESCRIPTION OF THE DRAWINGS

The invention is illustrated in the accompanying drawing wherein.

In the several views of the drawing, like parts are denoted by like reference numerals.

DETAILED DESCRIPTION OF THE PREFERRED EMBODIMENT

Figure 1A:
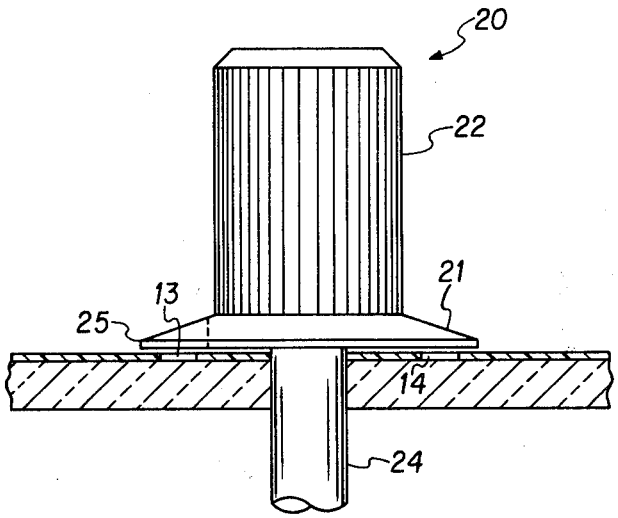
FIG. 1a (PRIOR ART)
FIG. 1A is a side elevation of a prior art knob in a "push" position, used in conjunction with a lighted display panel.
Figure 1B:
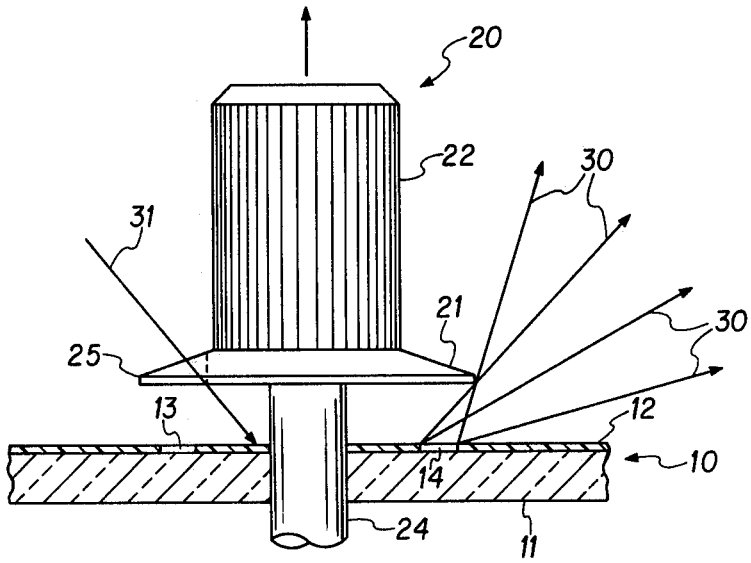
FIG. 1b (PRIOR ART)
FIG. 1B is a side elevation of the prior art knob of FIG. 1A in a "pull" position.

As mentioned above, the knob in accordance with the invention is intended principally for use in conjunction with instrument or display panels which may have apertured light transmitting indicating indicia. Thus, as shown in FIGS. 1A and 1B, a display panel 10 may include a translucent member 11 having an opaque layer 12 thereupon. Indicia are defined by apertures 13 and 14 (which may be merely transparent areas) through the opaque layer 12 to permit light within the transparent layer 11 to be transmitted therethrough.

A knob typical of the prior art is illustrated in FIGS. 1A and 1B and denoted generally by the reference numeral 20. The knob 20 includes a skirt or shouldered portion 21 and upstanding knob portion 22, and is mounted onto a shaft 24 of a multi-functional control device (not shown) located beneath the display panel 10. A transparent or window section 25 is provided on the skirt 21 through which the various underlying indicia can be viewed. In the embodiment shown, the transparent portion 25 is shown aligned with the aperture 13.

The prior art knob 20 enables the shaft 24 to be rotated, in usual fashion. To effect the push-pull function of the control device with which the shaft 24 is associated, the knob is merely pulled upwardly to the position shown in FIG. 1B. When this upward action is performed, however, the shoulder or skirt 21 is moved away from its position adjacent to the opaque layer 12 of the panel 10. Thus, light passing through aperture 14, which is an unselected function indication, can be seen over an undesirably wide range of angles, as indicated arrows denoted by the reference numeral 30. Additionally, since the window 25 is raised a distance from the selected aperture 13, the alignment of the window 25 is subject to a much larger degree of paralax, with a larger amount of surrounding panel surface near the aperture 13 being visible, as illustrated by the arrow 31.

It can further be appreciated that the illustrated prior art knob 20 provides no biasing upon the control shaft 24. Consequently, the inherent bias (if any) of the particular control device with which the knob is associated must be totally relied upon.

Figure 2:
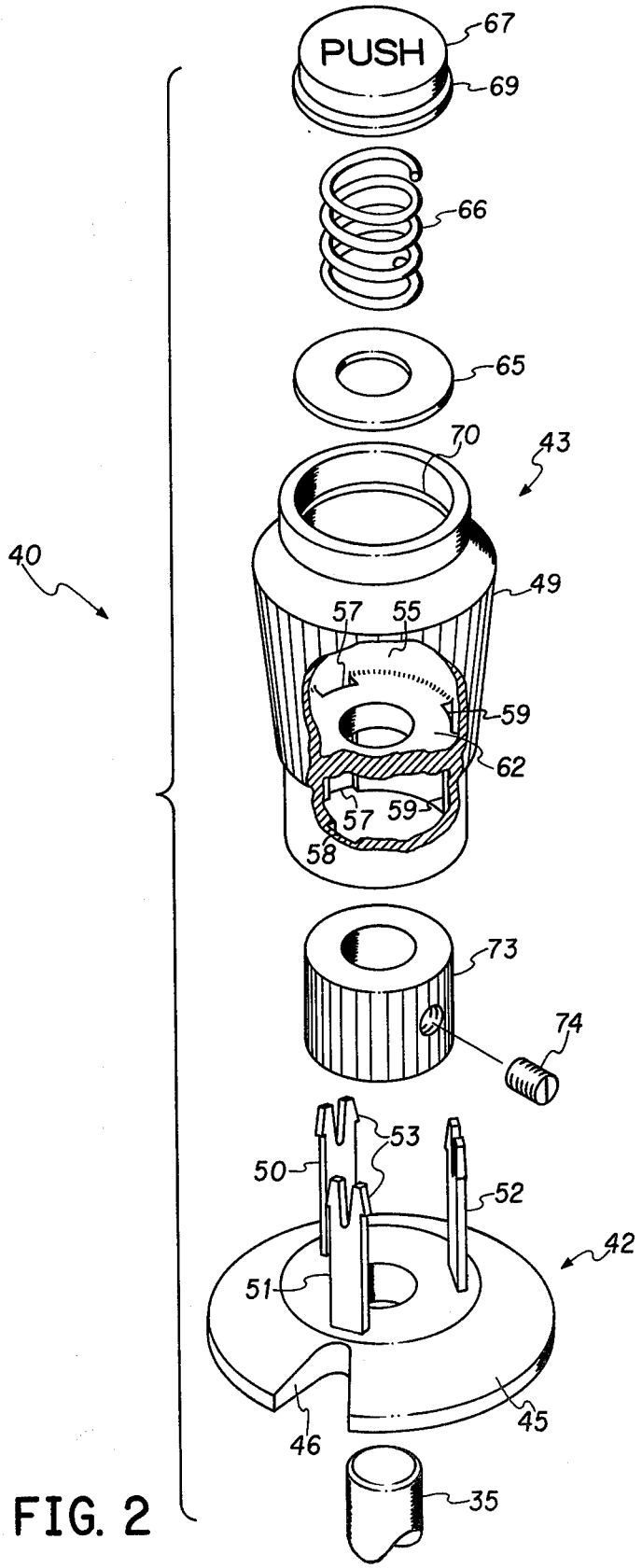
FIG. 2 is an exploded perspective view partially cut away of the knob in accordance with the present invention.
Figure 3:
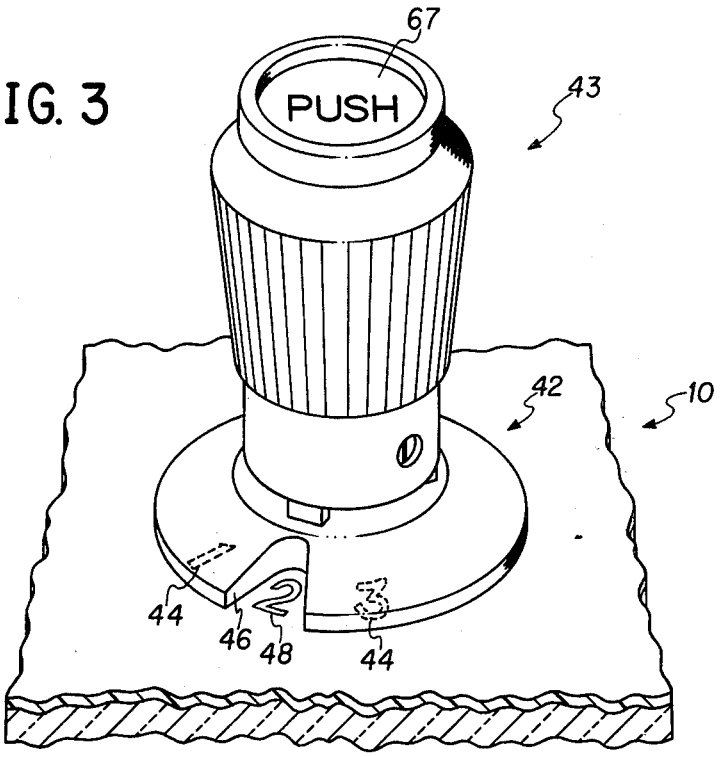
FIG. 3 is a perspective view of the knob in accordance with the present invention in operative association with a mounting panel.
Figure 4:
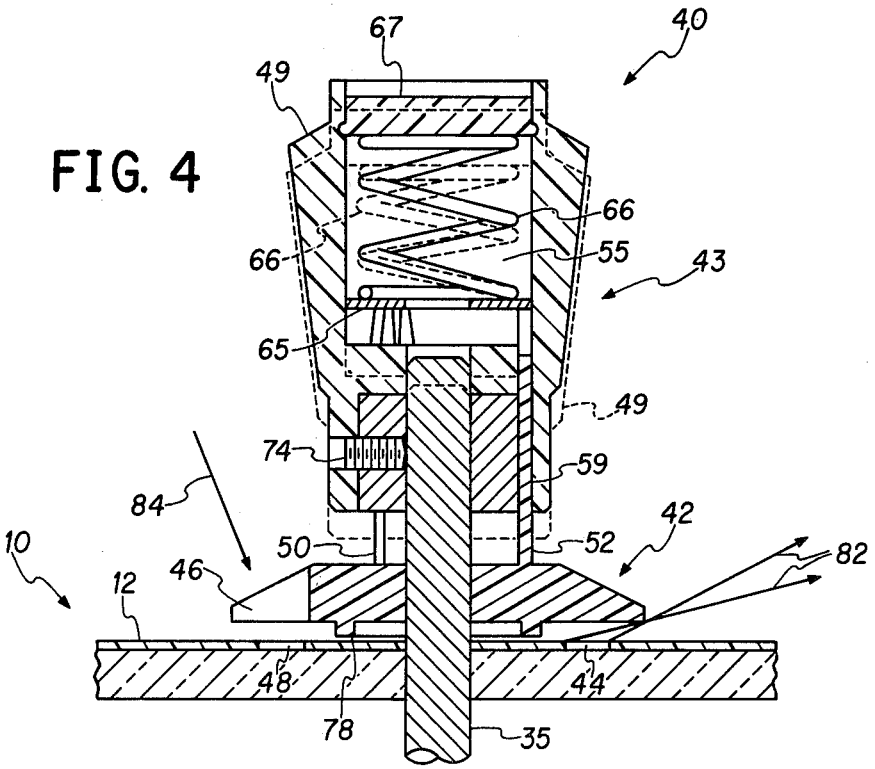
FIG. 4 is a cross-sectional side view of the knob in accordance with the invention, illustrating its operation.

Applicants' knob 40, on the other hand, as illustrated in FIGS. 2–4, includes two main sections, a skirt section 42 adapted to be implaced onto the panel 10 and an overlying knob section 43. The skirt section 42 and overlying knob section 43 can be of any material, but preferably is of an insulating material such as plastic or the like.

The skirt section 42 includes a circular skirt or shouldered portion 45 adapted to cover the indicia 44 which are unselected, as shown particularly in FIG. 3. A window 46 (which can be of transparent material, if desired) is provided on the shouldered portion 45 through which the selected indicia 48 can be viewed. In the embodiment shown, three arm members 50–52 are provided upstanding from the skirt section 42. The upstanding arm members 50–52 are received in corresponding channels or slots, below described, within the body 49 of the overlying knob section 43 to facilitate its axial (push-pull) motion, yet permitting the entire assembly including the skirt section 42 and knob section 43 to be rotated. In the actual fabrication of the skirt section 42, the upstanding arms 50–52 can be molded as a unitary part of the overall skirt section.

The overlying knob section 43 includes an interior chamber 55, as can be seen in the cutaway portion thereof in FIG. 2. Channels 57, 58 and 59 are formed in the wall of the chamber 55 to present walls to respectively slidingly receive the upstanding arms 50–52 of the skirt section 42. A centrally located retaining shoulder 62 is provided, through which the channels 57–59 extend to permit the arm members 50–52 to be slidable into the upper portion of the interior 55 of the knob section 43. A washer 65 and spring 66 are located in the upper portion of the chamber 55, maintained in position by a top cover 67 having a peripheral lip 69 which engages a slot 70 along the interior wall of the chamber 55. The washer 65 is of such size as to contact the arms 50–52 as they extend through the channels 57–59 into the upper portion of the chamber 55, as can be seen in FIG. 4.

An insert 73 of metal or other durable material is located within the lower portion of the chamber 55, primarily to provide a facility for enabling a set screw 74 to be reliably used to engage the shaft 35 of the particular control device (not shown). The insert 73 additionally provides an inner wall of the respective channels 57–59 within the lower part of the chamber 55.

The operation of the knob 40 is explained with reference primarily to the cross sectional view of FIG. 4. As shown, the knob 40 is mounted onto the shaft 35 of a control device (not shown), with the skirt section 42 lying directly on the opaque layer 12 of the panel 10. Spring 66 urges the overlying knob body 49 to the upward position illustrated. When it is desired to operate the "push" feature of the underlying control, the body 49 of the knob section 43 is simply pushed in the direction of the panel 10 to the position indicated by the dotted lines. The upstanding members 50–52 push the washer 65 upwardly within the chamber 55, compressing the spring 66 as shown. It should be emphasized, however, that the body of the skirt section 42 is not moved upwardly or downwardly with respect to the panel surface 12 in the push-pull operation of the knob assembly 40.

When rotational selection of the control device is desired, the upper knob section 43 is merely turned. The walls of the channels 57–59 then engage the arm members 50–52, rotating the skirt section 42 as well as the shaft 35.

If desired, a spacer 78 may be formed on the bottom portion of the skirt section 42 to provide a rotational bearing surface maintaining a desired slight height at which the skirt section is normally held with respect to the top surface 12 of the panel 10. The spacing can be selected such that the angle at which the unselected indicia 44 can be seen is minimized, the small angle of the light path therefrom being denoted by the arrows 82.

It should also be noted that since the windowed portion 46 of the skirt section 42 is not changed in its height above the selected apertured indicia 48, the viewing angle thereof, indicated by the arrow 84, remains unchanged regardless of the push-pull state of the knob 40.

It should finally be noted that because of the inclusion of the spring 66 within the chamber 55, any desired amount of spring biasing can be effected by the appropriate choice of the spring used.

Although the invention has been described and illustrated with a certain degree of particularity, it is understood that numerous changes in the arrangement and combination of parts may be resorted to without departing from the spirit and scope of the invention as hereinafter claimed.

We claim:

1. A knob adapted for mounting upon a shaft of a control device presenting push-pull and rotary selectable functions upon an associated panel of the type having indicia through which light may pass from a light source behind said panel for enabling night viewing, located at rotationally selectable positions, comprising:

a skirt slideably positionable on said shaft adjacent said panel to cover said indicia, said skirt having a window portion for disclosing selected indicia;

said skirt being located over said indicia to restrict them from view over an angle away from an axis along said shaft;

a plurality of arms attached to said skirt parallel to said shaft;

and an overlying knob attachable to said shaft, including therein longitudinal channel walls for axially slideably receiving said arms to facilitate the push-pull function selection and for engaging said arms when said overlying knob is rotated to rotate said skirt, said angle over which said indicia can be viewed being unaffected by by push-pull and rotation operations of said overlying knob.

2. The knob of claim 1 further comprising biasing means urging said knob away from said skirt to a pull position of said control, urging said skirt to a position adjacent said panel to insure the view of said covered indicia is restricted and to reduce the paralax in viewing said selected indicia.

3. The knob of claim 2 wherein said biasing means comprises a spring within a central cavity of said overlying knob engaging said arms therewithin.

4. The knob of claim 1 wherein said upwardly extending attached arms are three in number.

5. The knob of claim 1 wherein said skirt and overlying knob are of plastic.

6. The knob of claim 1 further comprising set screw attachment means extending through holes in said knob adapted to engage said shaft.

7. The knob of claim 6 further comprising a metal insert within a central cavity of said overlying knob having a threaded hole therein to receive said set screw attachment means.

8. The knob of claim 1 further comprising a spacer extending from said skirt to ride upon said display panel to maintain a preselected space between said panel and said skirt.

* * * * *